US005630435A

United States Patent [19]

Brouchoud et al.

[11] Patent Number: 5,630,435

[45] Date of Patent: May 20, 1997

[54] REMOVABLE SPLIT CANOPY FOR AN INDUSTRIAL PARTS WASHER

[75] Inventors: Jeffery P. Brouchoud, Appleton; Keith D. Daun, Waupun, both of Wis.

[73] Assignee: Alliance Manufacturing, Inc., Fond du Lac, Wis.

[21] Appl. No.: 596,661

[22] Filed: Feb. 5, 1996

[51] Int. Cl.[6] ..... B08B 15/00

[52] U.S. Cl. ..... 134/68; 134/72; 134/200; 134/183

[58] Field of Search ..... 134/200, 61, 62, 134/66, 68, 69, 70, 71, 72, 570 L, 580 L, 182, 183

[56] References Cited

U.S. PATENT DOCUMENTS

| | | | |
|---|---|---|---|
| 1,946,805 | 2/1934 | Mojonnier | 134/72 |
| 3,040,874 | 6/1962 | Lyman | 134/48 X |
| 3,106,925 | 10/1963 | Rand | 134/66 |
| 3,203,435 | 8/1965 | Kurtz | 134/70 |
| 3,339,564 | 9/1967 | Kraeft | 139/68 X |
| 3,586,538 | 6/1971 | Wilson | 134/68 |
| 3,804,104 | 4/1974 | James | 134/72 |
| 3,949,770 | 4/1976 | Noren | 134/83 |
| 3,958,586 | 5/1976 | Schnelle | 134/68 |
| 3,985,226 | 10/1976 | Noren | 134/83 |
| 4,960,143 | 10/1990 | Dore, Jr. et al. | 134/199 |
| 5,213,117 | 5/1993 | Yamamoto | 134/58 DL |
| 5,240,018 | 8/1993 | Clark et al. | 134/64 R |
| 5,265,633 | 11/1993 | Knowlton | 134/135 |
| 5,439,015 | 8/1995 | Shibano | 134/66 |

FOREIGN PATENT DOCUMENTS

| | | | |
|---|---|---|---|
| 1565402 | 5/1969 | France | 134/68 |
| 1103151 | 2/1968 | United Kingdom | 134/68 |

OTHER PUBLICATIONS

Alliance Manufacturing, Inc. "Aqueous Parts Washers" (1 page).

Roilgard, Inc. "Conveyor and Cabinet Washing Systems" (1 page).

ADF Systems, Ltd. "Flow Through Systems" (1 page).

M.B.C.W. "Model 24 ×16" Bulletin No. 32/92 (1 page).

Acme Fab "Industrial Cleaning Equipment, Ovens and Systems" (2 pages).

Final Phase "S" Series Washers (1 page).

Hurricane Systems, Inc. "The Widest Selection of Aqueous Parts Cleaning Systems Available" (1 page).

*Primary Examiner*—Frankie L. Stinson
*Attorney, Agent, or Firm*—Nilles & Nilles, S.C.

[57] ABSTRACT

An industrial parts washer having a split canopy for enclosing the processing zones and conveyor system of the washer includes a fixed first section and a selectively removable second section for accessing the internal processing areas of the washer. The removable section of the canopy is optionally constructed as a single piece of material covering all processing zones across the length of the washer, or alternatively the removable section is segmented into two or more subsections which are easily removed and replaced onto the washer by one or two operators. The removable sections of the canopy are releasably attached to the washer with appropriate quick release latches, and the removable section of the canopy is appropriately sealed to the washer to prevent the escape of moisture, steam and chemical contaminants. The canopy is also made of molded fiberglass or plastic materials.

13 Claims, 5 Drawing Sheets

REMOVABLE SPLIT CANOPY FOR AN INDUSTRIAL PARTS WASHER

BACKGROUND OF THE INVENTION

1. Field of the Invention

The present invention relates to a removable split canopy for accessing the processing zones of an industrial parts washer of the type used for cleaning and removing manufacturing soils from manufactured industrial parts.

2. Background of the Related Art

A wide range of manufactured industrial parts, especially metal fabricated parts become soiled with lubricating oils, machine coolants, metal chips, dust and other contaminants during the manufacturing process. For example, a metal cutting operation often involves the application of a lubricant or coolant onto the part being manufactured during the cutting process. Industrial parts washers are used to remove manufacturing soils and clean the part prior to assembly and use of the part in a finished product.

An industrial parts washer typically comprises one or more processing zones for washing, rinsing, blowing-off, drying and other steps for cleaning the parts. A conveyor transports the parts through the processing zones from one end of the washer to the other. Because industrial parts washers spray the parts with hot water and various cleaning agents, most washers usually have a canopy for enclosing the processing zones of the machine.

The canopy on a typical industrial parts washer ordinarily incorporates a large metal shroud which extends along nearly the entire length of the machine. Although such canopies have proven to be quite durable and relatively easy to fabricate, the large, bulky, single piece construction greatly inhibits access to the interior areas of the processing zones of the washing machine. Like all industrial equipment, parts washers are subject to mechanical failure and require routine cleaning and maintenance, particularly on the conveyors, spray nozzles and blowers. Several manufacturers of industrial parts washers have attempted to address the problem of access by adding access doors or removable side panels onto the side of the canopy, however, such restricted openings are nonetheless still quite limited in accessing the interior areas of the machine. Several other manufacturers have attempted to solve the problem by designing a canopy which is removable in its entirety, however, due to the heavy weight and bulky nature of such a canopy, mechanical hoists and/or overhead cranes are usually needed to remove the canopy. Also, a canopy which is completely removable cannot be used for structural support for interior components of the machine.

Consequently, there is a need for a means for effectively enclosing the processing zones of an industrial parts washer yet provide users with ready accessibility to the interior areas of the machine.

SUMMARY OF THE INVENTION

A removable split canopy for an industrial parts washer is disclosed. The canopy comprises an elongated canopy covering the conveyor and processing zones of the washer. The canopy is made of a lightweight, corrosion resistant material. Furthermore, the canopy has a seam extending longitudinally from one end of the canopy to the other, thereby splitting the canopy into two separate sections. At least one section of the canopy is releasably attached to the machine with quick release fastening devices, thereby making it easy for operators and maintenance persons to selectively remove and replace the removable section of the canopy on and off the machine as desired. The removable section of the canopy may also be segmented into two or more subsections, further facilitating removal of the canopy from the machine.

The present invention enjoys several advantages. First, the removability of a essentially one-half of the canopy greatly enhances access to the internal components of the machine for maintenance purposes, yet the remaining fixed portion of the canopy provides structural support for those same internal components. Also, the segmented subsections of the removable portion of the canopy enable an operator or maintenance person to easily remove those sections of the canopy without the need for additional personnel or heavy lifting equipment.

Finally, the fiberglass composition of the canopy insulates against heat loss from the hot water, steam and hot air used in the washing and drying processing zones of the machine, and protects the operator and surrounding work environment from such heat.

Other objects, features and advantages of the present invention will become apparent to those skilled in the art from the following detailed description of the invention and accompanying drawings. It should be understood, however, that the detailed description presented below, while indicating preferred embodiments of the invention, are given by way of illustration and not limitation. Many changes and modifications within the scope of the invention may be made without departing from the spirit thereof, and the invention includes all such modifications.

BRIEF DESCRIPTION OF THE DRAWINGS

A preferred exemplary embodiment of the invention is illustrated in the accompanying drawings in which like reference numerals represent like parts throughout, and which.

DETAILED DESCRIPTION OF THE INVENTION

Figure 1:
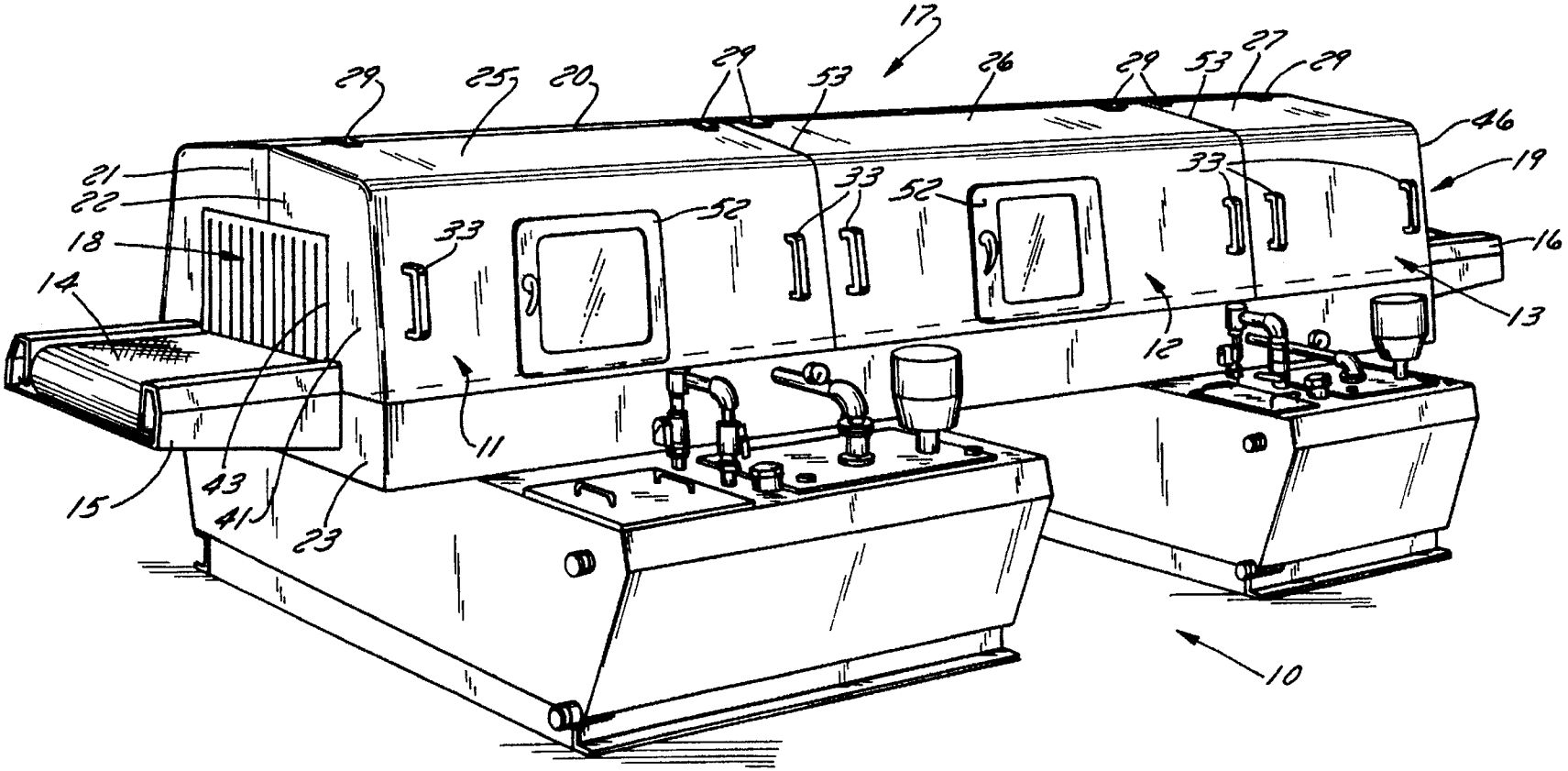
FIG. 1 is a perspective view of an industrial parts washer having a removable split canopy as disclosed herein.

Referring to the drawings, FIG. 1 shows an industrial parts washer 10, sometimes called a conveyorized aqueous parts washer, used for removing soils and contaminants from manufactured parts. The parts washer includes one or more processing zones for washing, rinsing, blowing-off or drying the parts being cleaned. For example, the parts washer 10 shown in FIG. 1 comprises three separate processing zones: a first processing zone 11 for washing the parts with steam or hot water and a chemical detergent, a second processing zone 12 for rinsing the parts, and a third processing zone 13 for blowing-off or drying the parts.

The processing zones are arranged in sequential order so that the parts may be conveyed on an automatic conveyor mechanism 14 in a linear direction through all of the processing zones. Typically, an elongated, horizontal belt-type conveyor 14 is used for transporting the parts through the processing zones. Referring specifically to FIG. 1, the conveyor 14 has a first end portion 15 for loading the parts into the first processing zone 11 of the washer 10, and a second end portion 16 for unloading the parts from the third or last processing zone 13. The parts are placed on top of the conveyor 14 and automatically transported through the washer 10. Although a belt-type conveyor 14 is shown in the drawings, alternatively an overhead monorail-type conveyor and other conveying mechanisms may be employed.

Figure 2:
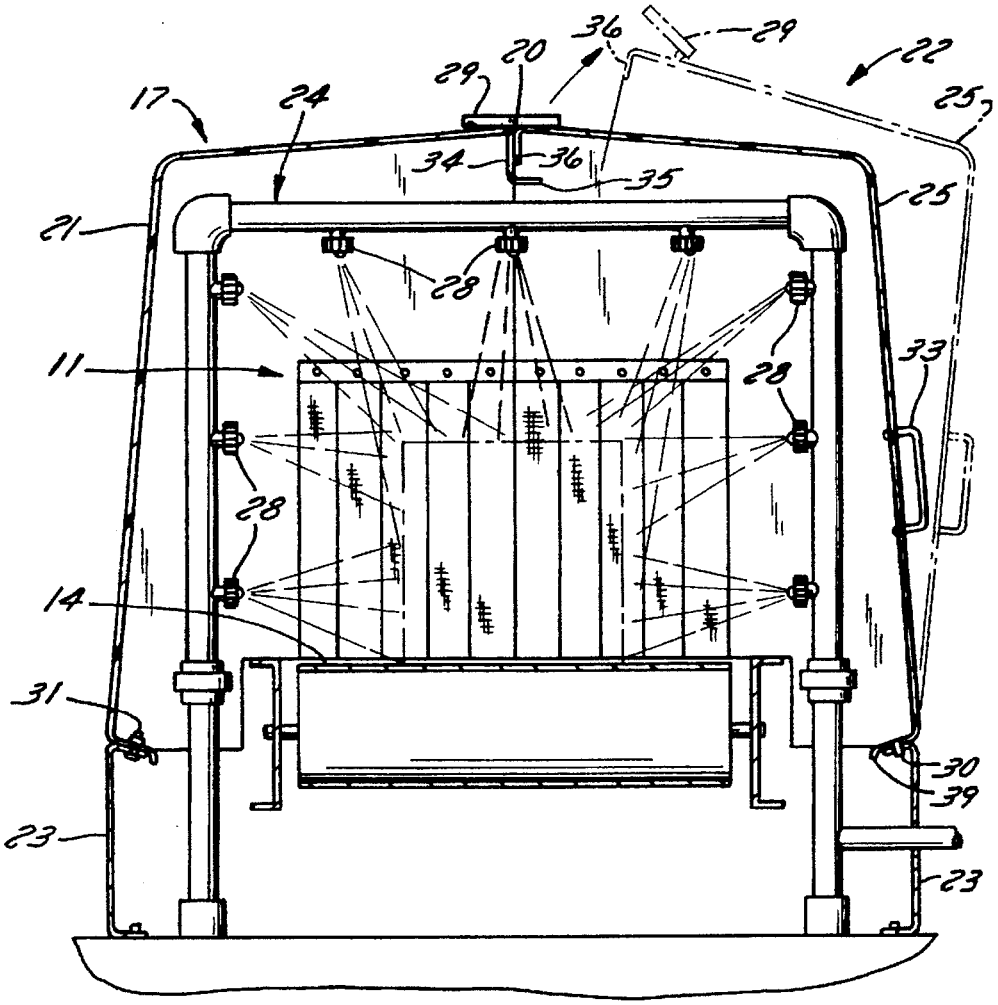
FIG. 2 is a cross section view of a processing zone of an industrial parts washing machine, in particular a spraying zone, showing the removable section of the canopy.
Figure 3:
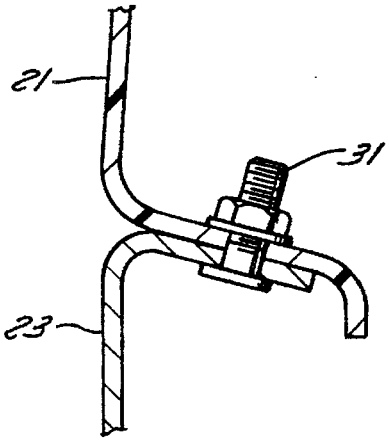
FIG. 3 is an enlarged detail view of the fastening bolt for rigidly fastening the fixed section of the canopy onto the frame of the machine.

Referring to FIG. 2, the respective processing zone includes equipment for spraying or blowing-off the part as desired. Further, and again referring to FIGS. 1 and 2, a canopy 17 covers both the processing zones and the conveyor, and the canopy 17 extends from one end of the machine to the other. The canopy 17 has a first opening 18 located over the first end portion 15 of the conveyor 14 where the parts are loaded into the washer 10, and the canopy 17 has a second opening 19 located over the second end portion 16 of the canopy 17 where parts are unloaded from the washer 10. The canopy further comprises a substantially vertical first side portion, a substantially vertical second side portion, and a substantially horizontal central top portion between and adjoined to the first side portion and second side portion. A seam 20 extending longitudinally down the entire length of the central top portion canopy 17 from the first opening 18 to the second opening 19 effectively splits the canopy 17 into two separate sections: a first section 21 and a second section 22.

Figure 5:
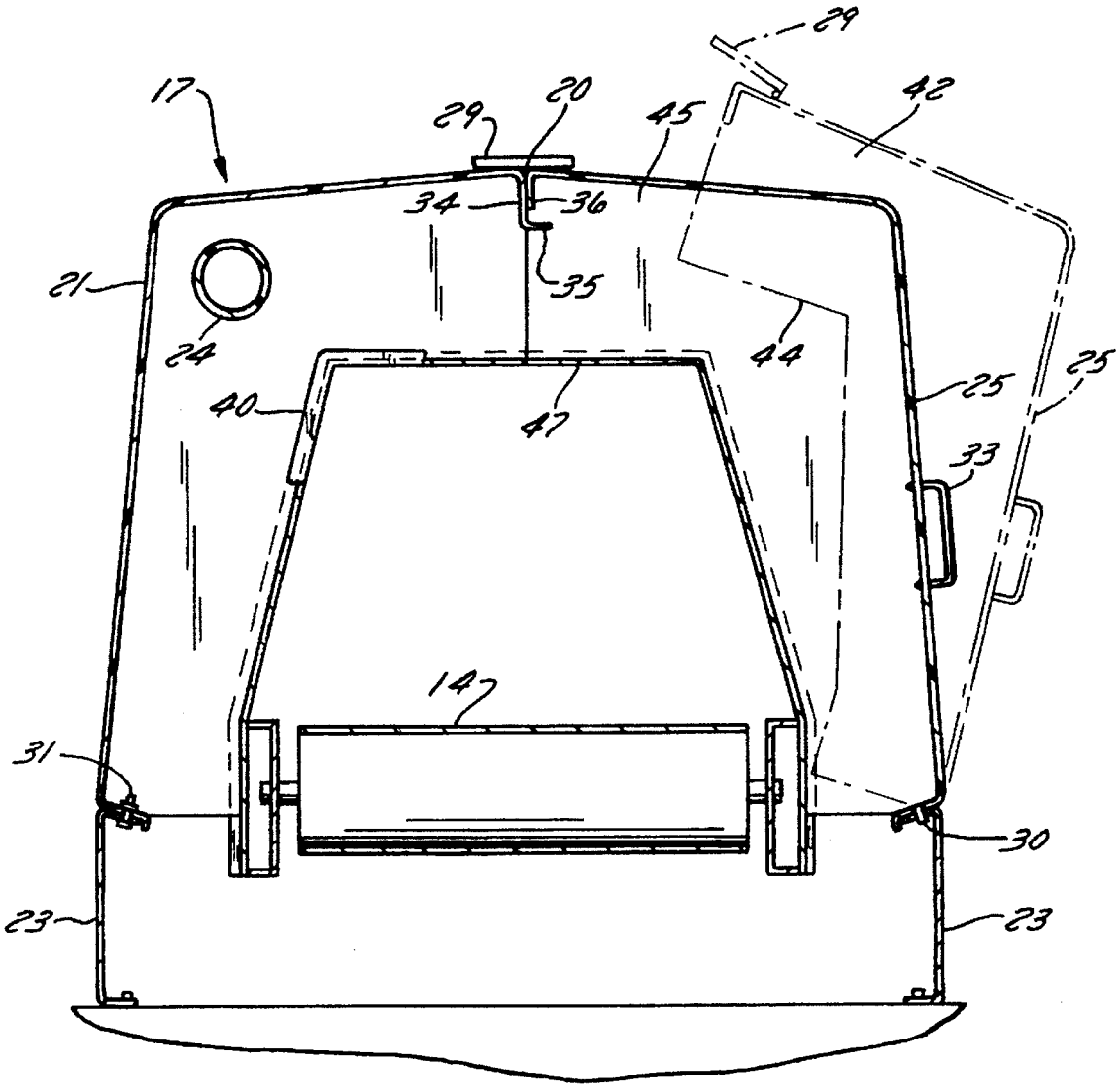
FIG. 5 is a cross section view showing the structural support provided to internal components of the processing zones by the fixed section of the canopy, and further showing a metal support bracket for supporting the canopy and for sealing two adjacent removable subsection of the canopy.

In further reference to FIG. 2, the first section 21 of the canopy 17 preferably is rigidly fixed to the frame 23 of the parts washer 10, and the second section 22 of the canopy 17 is removably attached to the machine 10. It has been found that sufficient access into the internal areas of the washer 10 can be achieved by having only one section of the canopy being removable, meaning that only one half of the canopy is ordinarily removed from the machine for routine cleaning and maintenance purposes. Further, by rigidly mounting the fixed section 21 of the canopy 17 to the frame 23 of the parts washer 10, the fixed section 21 provides additional structural support for piping 24, spray nozzles 28 and other internal components of the machine as shown in FIGS. 2 and 5.

The removable section 22 of the canopy 17 is further segmented into two or more subsections, wherein each subsection is independently removable from the washer 10. For example, looking at the removable section 22 of the canopy 17 on a three-zone washer as shown in FIG. 1, the first processing zone 11 is covered by a first removable subsection 25, the second processing zone 12 is covered by a second removable subsection 26, and the third processing zone 13 is covered by a third removable subsection 27. Each subsection 25, 26 and 27 may be independently lifted on end off of the washer 10 thereby enabling the operator to address a single area of the machine which needs attention. For example, spray nozzles, which are prone to clogging, may be checked and replaced by removing only one subsection of the canopy without disturbing the other areas of the machine.

Preferably the canopy 17 is made from molded fiberglass, plastic or other lightweight, noncorrosive insulating material. Fiberglass provides a distinct advantage in that a fiberglass canopy 17 insulates against heat loss from hot water and steam used in the cleaning processes, and further insulates operators and other personnel from exposure to high temperatures due to steam and hot water applications occurring within the machine. Of course, a number of alternative equivalent materials and plastics could be used to fabricate the canopy.

Figure 4:
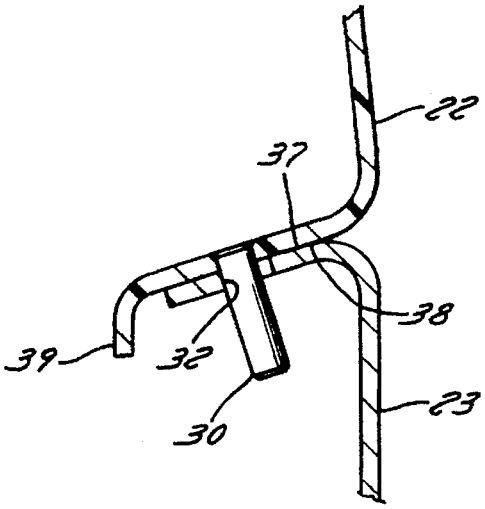
FIG. 4 is an enlarged detailed view of the locating pin for locating and seating the removable section of the canopy onto the frame of the machine.

The fixed section 21 of the canopy 17 is preferably bolted 31 or otherwise rigidly fastened to the frame 23 of the washer 10. The removable section 22 of the canopy 17 is attached to the parts washer 10 with a set of quick release latches 29 and locating pins 30. Referring to FIGS. 2 and 4, two or more quick release latches 29 along the seam 20 on the top portion of the canopy 17 secure the removable section 22 of the canopy 17 to the fixed section 21. Locating pins 30 on the bottom edge of the removable section 22 fit into corresponding holes 32 in the frame 23 of the parts washer 10 for locating and seating the removable section 22 onto the frame 23 of the machine 10. Obviously, a number of alternative equivalent means could be employed for fastening the removable section 22 of the canopy 17 to the parts washing machine 10. The removable sections of the canopy 17 also have two or more handles 33 for assisting operators in removing those sections from the parts washer 10.

As mentioned above, the process for cleaning industrial parts often involves spraying the parts with hot water and with a chemical detergent. For that reason, the canopy 17 must include a means for sealing the seam 20 between the fixed section 21 and removable section 22 in order to prevent the escape of steam, moisture and chemical contaminants. In the embodiment shown in FIG. 2, the fixed section 21 and removable section 22 of the canopy 17 are sealed together by firmly seating two flat surfaces of fiberglass together. Specifically, the upper edge of the fixed section 21 of the canopy has a narrow downward projecting first sealing surface 34 and a narrow horizontally projecting ridge 35. The narrow first sealing surface 34 and projecting ridge 35 extend across the complete length of the canopy 17 from the first opening 18 of the canopy 17 to the second opening 19 of the canopy 17. The upper edge of the removable section 22 of the canopy 17 has a similar downward projecting second narrow sealing surface 36. When the removable section 22 of the canopy 17 is placed onto the machine, the second narrow sealing surface 36 on the removable section 22 of the canopy 17 abuts against the first narrow sealing surface 34 on the fixed section 21 of the canopy 17. The seating of the two fiberglass sealing surfaces 34 and 36 together effectively seals the upper seam 20 of the canopy. Further, the ridge 35 on the fixed section 21 of the canopy 17 wraps underneath the narrow second narrow sealing surface 36 on the removable section 22 of the canopy 17 in order to block any water that may be spraying directly onto the seam 20 between the first and second sealing surfaces 34 and 36.

Similarly, in order to seal the lower edge of the removable section 22 of the canopy 17 to the frame 23 of the machine 10, a narrow inward projecting third sealing surface 37 on the lower edge of the removable section 22 of the canopy 17 abuts against a narrow inwardly projecting fourth sealing surface 38 on the frame 23 of the machine 10. The third narrow sealing surface 37 of the lower edge of the removable section 22 of the canopy 17 similarly has a downward turned ridge 39 which wraps over the end of the fourth narrow sealing surface 38 on the frame 23 of the machine 10. Again, the surface to surface contact between the third and fourth narrow sealing surfaces 37 and 38 effectively seals the lower edge of the removable section 22 of the canopy 17 to the frame 23 of the parts washer 10. Also, the downward tunnel ridge 39 on the removable section 22 of the canopy 17 wraps over the fourth narrow sealing surface 38 on the frame 23 in order to block any water that may be spraying directly onto the seam between the third and fourth sealing surfaces 37 and 38. Obviously, a number of alternative equivalent means may be employed for providing a steam and leak proof seal for the canopy 17.

Referring again to FIG. 1 in which the removable section 22 of the canopy 17 is further segmented into a number of subsections, there is obviously a secondary seam 53 between the subsections which extends from the top center portion of the canopy 17 down to the frame 23. This secondary seam 53 is similarly sealed by placing the end surfaces of two adjacent subsections of the canopy together. In applications where additional sealing protection or additional structural support for the subsection is desired, an internal support bracket 40 placed between the two adjacent subsections of the canopy wraps around the edges of the two end surfaces thereof.

For example, looking specifically at the secondary seam 53 between the first subsection 25 and second subsection 26 of the canopy 17 shown in FIG. 1, the first subsection 25 of the canopy has on one end a first end surface 41 and on the opposite end a second end surface 42 shown in FIG. 5. The first end surface 41 has a first end surface edge 43 which forms part of the opening where parts enter into the first processing zone 11 of the washer 10, and the second end surface 42 has a second end surface edge 44 which forms part of the opening where parts exit from the first processing zone 11 of the washer 10. Similarly, the second subsection 26 of the canopy 17 has on one end a third end surface 45 and on the opposite end a fourth end surface 46. Also, the third end surface 45 has a third end surface edge 47 which forms a part of the opening where parts enter into the second processing zone 12 of the washer 10, and the fourth end surface 46 has a fourth end surface edge 48 which forms a part of the opening where parts exit the second processing zone of the washer 10. When the first subsection 25 and second subsection 26 of the canopy 17 are fully installed on the washer 10, the second end surface 42 of the first subsection 25 of the canopy 17 lies adjacent to and parallel to the third end surface 45 of the second subsection 26 of the canopy 17. Further, the internal support bracket 40, shown in FIG. 5, wraps around the second end surface edge 43 of the first subsection 25 and around the third end surface edge 47 of the second subsection 26 in order to provide a steam and moisture proof seal between the two subsections 25 and 26.

Figure 6:
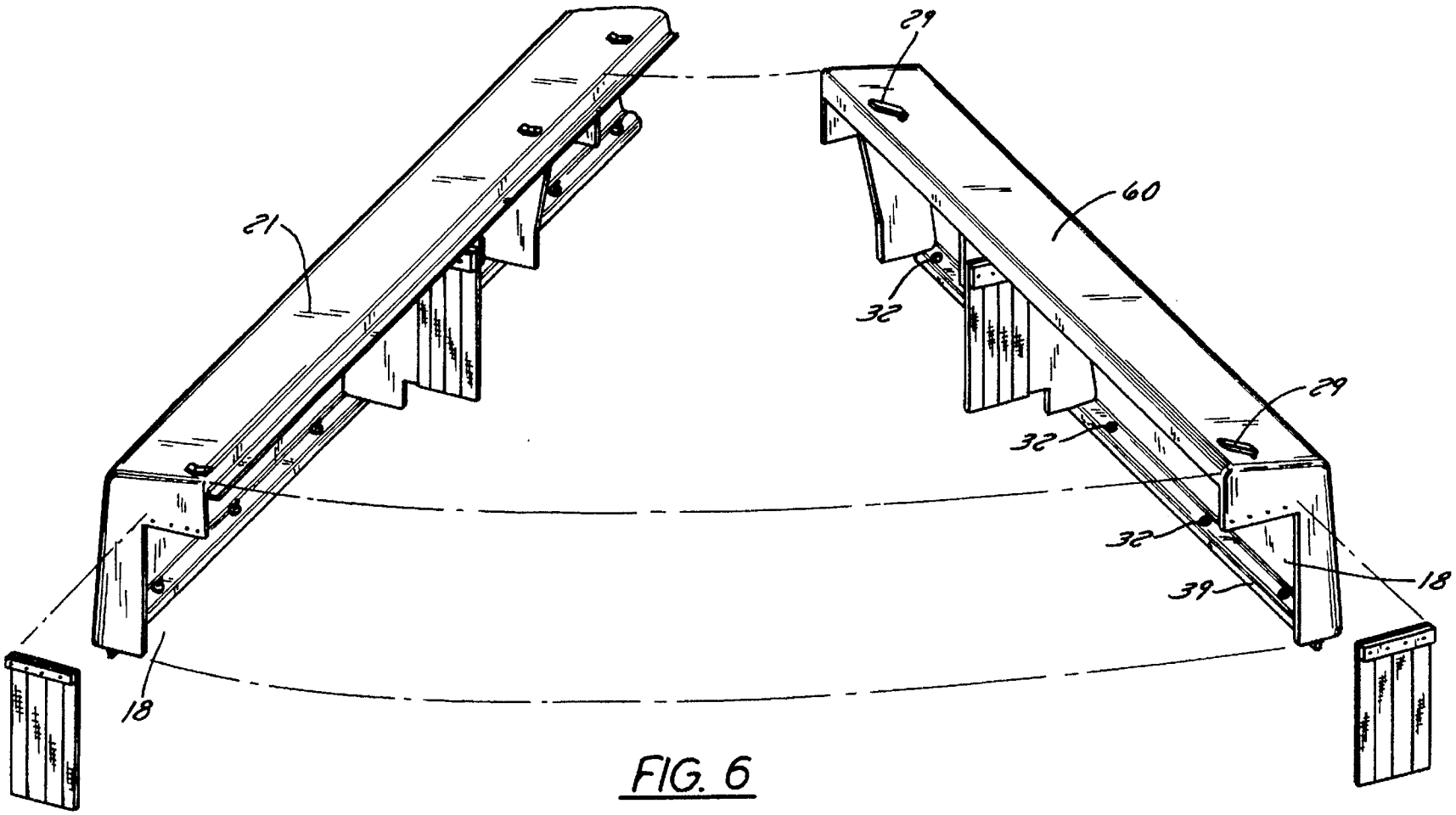
FIG. 6 is a perspective view of the fixed and removable sections, respectively, of a second embodiment of the split canopy disclosed herein.
Figure 7:
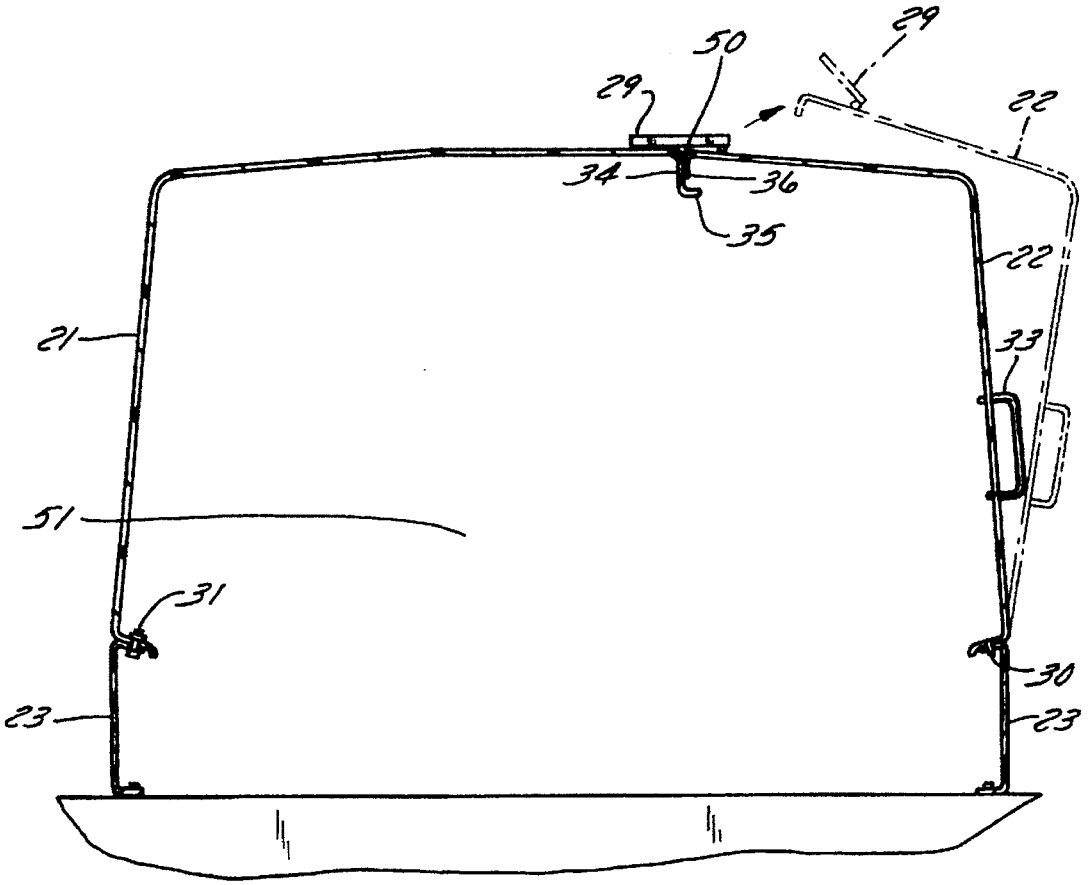
FIG. 7 is a cross section view of a third embodiment of the split canopy disclosed herein wherein the canopy has an enlarged width in order to accommodate an extra-wide conveyor and processing system, and showing an off-center seam for dividing the fixed and removable sections of the canopy, respectively.

The embodiments of the invention shown in FIGS. 1–6 show the canopy 17 being split essentially down the center. The symmetry between the two sections 21 and 22 provides efficiencies in manufacturing the canopy 17, especially with molded fiberglass. Of course, depending on the application, the split canopy disclosed herein may have an off-center seam 50 as shown in FIG. 7. The use of an off-center seam 50 might be used, for example, on a parts washer which requires an extra-wide processing zone 51 and conveyor system.

The split canopy of the present invention may be further provided with conventional viewing windows, access doors, or an access door with a window 52 in it as shown in FIG. 1. The canopy may also be provided with conventional sensors and interlocks to shut down the machine in the event a portion of the canopy is removed or an access door is opened.

The split canopy disclosed herein is very versatile and may be modified to fit a wide range of parts washing machines. Specifically, the split canopy described above and shown in FIGS. 1–5 has a first section 21 rigidly fixed to the frame 23 of the machine 10 and a second section 22 removably attached to the machine 10. Of course, depending on the application, it may be desirable to have both sections removable. Also, the split canopy shown specifically in FIG. 1 is segmented into a number of subsections 25, 26 and 27, but alternatively the removable section of the canopy may be formed as a single piece of material 60 extending the entire length of the machine as shown in FIG. 6. As a further alternative, both the front and back sides of the canopy may be segmented into multiple subsections, and, one or more subsections of the front side may be removable and in addition one or more subsections of the backside of the canopy may likewise be removable.

Therefore, it is to be understood that the embodiments disclosed above are merely exemplary of the invention which may be embodied in various forms. Specific structural and functional details described above are not to be interpreted as limiting, but merely as a basis for the claims and as a representative basis for teaching one skilled in the art to variously employ the present invention in any appropriately detailed structure. Changes may be made in the details of construction, arrangement and operation of the invention without departing from the spirit of the invention, especially as defined in the following claims.

Therefore, we claim as our invention the following:

1. A canopy for an industrial parts washer, said washer comprising one or more processing zones for removing manufacturing soils from manufactured industrial parts, and an elongated, horizontal conveyor for transporting the parts through the processing zones, said conveyor having a first end portion for introducing the parts into the processing zones and a second end portion for removing the parts from the processing zones, said canopy comprising:

an elongated corrosion resistant canopy covering the conveyor and processing zones of the parts washer, the canopy having a first side portion, a second side portion, and a central top portion between and adjoined to the first side portion and second side portion, and the canopy further having a first opening over the first end portion of the conveyor and a second opening over the second end portion of the conveyor;

the canopy having a seam extending longitudinally down the central top portion from the first opening to the second opening thereby splitting the canopy into a first section and second section;

the first section of the canopy being attached to the parts washer; and, the second section of the canopy being releasably fastened to the parts washer for selectively and completely removing the second section from said parts washer for exposing the processing zones of the parts washer and replacing the second section back onto said parts washer.

2. The canopy for an industrial parts washer according to claim 1, wherein:

the first section of the canopy further comprises a narrow downward projecting first sealing surface and a narrow horizontally projecting ridge, wherein the first sealing surface and the projecting ridge extend along the entire length of the canopy from the first opening to the second opening of the canopy; and, the removable second section of the canopy further comprises a narrow downward projecting second sealing surface which abuts against the first surface and over the projecting ridge to seal the removable second section of the canopy to the fixed first section.

3. The canopy for an industrial pans washer according to claim 1 wherein the removable second section of the canopy is segmented into two or more subsections, and each subsection is independently selectively removable from the parts washer.

4. The canopy for an industrial parts washer according to claim 3 further comprising two or more handles on each removable subsection of the canopy.

5. The canopy for an industrial pans washer according to claim 3 wherein each removable subsection of the canopy further comprises two or more locating pins for locating and seating the subsections onto the parts washer.

6. The canopy for an industrial pans washer according to claim 3 wherein each removable subsection of the canopy further comprises two or more quick release latches for fastening removable subsections to the first section of the canopy.

7. The canopy for an industrial parts washer according to claim 1 wherein the canopy is made of fiberglass.

8. The canopy for an industrial parts washer according to claim 1 wherein:

the first section of the canopy is segmented into subsections comprising a first subsection attached to the parts washer and a second subsection selectively removable from the parts washer; and, the second section of the canopy is segmented into subsections comprising a third subsection attached to the parts washer and a fourth subsection selectively removable from the parts washer.

9. The canopy for an industrial parts washer according to claim 1 wherein the removable second section of the canopy further comprises a viewing window.

10. The canopy for an industrial parts washer according to claim 1 wherein the removable second section of the canopy further comprises an access door.

11. The canopy for an industrial parts washer according to claim 10 where in the access door further comprises a viewing window thereon.

12. The canopy for an industrial parts washer according to claim 1 in which the seam extends substantially down the middle of the central top section of the canopy.

13. The canopy for an industrial parts washer according to claim 1 in which the seam is offset toward a side of the external top section of the canopy.

* * * * *